US010577807B2

(12) United States Patent
Doupe et al.

(10) Patent No.: US 10,577,807 B2
(45) Date of Patent: Mar. 3, 2020

(54) DECKING CLIP

(71) Applicant: KLEVAKLIP SYSTEMS PTY LTD., Cromer NSW (AU)

(72) Inventors: Greg James Doupe, Cromer NSW (AU); Stephen Ley Sanders, Cromer NSW (AU)

(73) Assignee: KLEVAKLIP SYSTEMS PTY LTD., Cromer NSW (AU)

( * ) Notice: Subject to any disclaimer, the term of this patent is extended or adjusted under 35 U.S.C. 154(b) by 0 days.

(21) Appl. No.: 16/172,974

(22) Filed: Oct. 29, 2018

(65) Prior Publication Data

US 2019/0136546 A1 May 9, 2019

(30) Foreign Application Priority Data

Nov. 3, 2017 (AU) ..... 2017904473

(51) Int. Cl.
*E04F 15/02* (2006.01)
*E04F 15/10* (2006.01)
*E04B 5/02* (2006.01)

(52) U.S. Cl.
CPC ..... *E04F 15/02044* (2013.01); *E04B 5/026* (2013.01); *E04F 15/10* (2013.01);
(Continued)

(58) Field of Classification Search
CPC ..... E04F 15/02044; E04F 15/10; E04F 2015/02094; E04F 2201/05; E04B 5/023; E04B 5/026
(Continued)

(56) References Cited

U.S. PATENT DOCUMENTS 4,145,976 A * 3/1979 Svirklys ..... B65D 19/0095 108/56.1
5,553,427 A * 9/1996 Andres ..... E04B 5/026 52/177

(Continued)

*Primary Examiner* — Joshua K Ihezie
(74) *Attorney, Agent, or Firm* — Lando & Anastasi, LLP

(57) ABSTRACT

A decking clip to allow a plurality of decking members to be attached relative to a support assembly, the decking clip including an elongate plastic body strip having a body length, the body provided with a number of openings to receive fasteners there through to attach the body relative to the support assembly, a number of upstands spaced over the body length and extending substantially perpendicularly from the body strip, substantially transversely to the body length, each upstand having at least two opposed decking board engagement arms, a first decking board engagement arm extending from a first lateral side of the upstand at an acute angle and a second decking board engagement arm extending from a second lateral side of the upstand at an acute angle, at least two centering members, at least one centering member extending from the first lateral side of the upstand between the first decking board engagement arm and the body strip and at least one centering member extending from the second lateral side of the upstand between the second decking board engagement arm and the body strip, each upstand and/or engagement arm being resiliently deformable to allow portion of a decking board to pass and to retain the decking board relative to the support assembly in a spaced apart, non-overlapping configuration.

16 Claims, 5 Drawing Sheets

(52) U.S. Cl.
CPC ..... *E04B 5/023* (2013.01); *E04F 2015/02094* (2013.01); *E04F 2201/05* (2013.01)

(58) Field of Classification Search
USPC ..... 52/650.3, 170, 177, 712, 713, 714, 702, 52/289, 263, 157, 161, 295, 126.1, 126
See application file for complete search history.

(56) References Cited

U.S. PATENT DOCUMENTS 5,617,689 A * 4/1997 Beane ..... E04C 3/06 52/177
5,735,097 A * 4/1998 Cheyne ..... B63B 5/06 114/263
5,950,377 A * 9/1999 Yoder ..... E04F 15/10 52/177
6,233,886 B1 * 5/2001 Andres ..... E01C 5/005 114/267
6,301,842 B1 * 10/2001 Chaney ..... E04B 5/12 52/177
6,594,961 B2 * 7/2003 Leines ..... E01C 5/20 52/177
7,900,417 B1 * 3/2011 Leines ..... E04C 3/06 52/650.3
9,133,588 B2 * 9/2015 Stroyer ..... E01D 2/00
9,416,546 B2 * 8/2016 Claudin ..... E04F 15/02022
2002/0056238 A1 * 5/2002 Leines ..... E01C 5/20 52/177
2003/0154662 A1 * 8/2003 Bruchu ..... E04F 15/10 52/87
2005/0271852 A1 * 12/2005 Solomon ..... E04B 1/6141 428/58
2009/0094925 A1 * 4/2009 Andres ..... E04F 15/02 52/511
2009/0115186 A1 * 5/2009 Esser ..... B65G 53/52 285/55
2012/0227348 A1 * 9/2012 Turner ..... E04F 13/0823 52/582.1
2015/0082734 A1 * 3/2015 Leines ..... E04B 5/023 52/650.3
2015/0096256 A1 * 4/2015 Lam ..... E04F 15/02044 52/582.1
2017/0051515 A1 * 2/2017 Aquilani ..... E04F 13/0835
2019/0055974 A1 * 2/2019 Vandenberg ..... F16B 12/2063

* cited by examiner

DECKING CLIP

CROSS-REFERENCE TO RELATED APPLICATION

This application claims the benefit under 35 U.S.C. § 119 of Australian Patent Application No. 2017904473 filed on Nov. 3, 2017 which is hereby incorporated herein by reference in its entirety for all purposes.

TECHNICAL FIELD

The present invention relates to decking and particularly to a decking clip or fastener allowing a number of decking boards to be laid quickly and easily whilst employing a self-centering assembly to make allowance for variation of size of boards inserted into the clip

BACKGROUND ART

Wood-Plastic Composite (WPC) decking boards have been in the marketplace around the world since the mid 1990's and arguably account for approximately 10% of the world decking market.

Despite the fact that the WPC's are generally more expensive than all but the most expensive timber, they have achieved huge inroads due to their perceived advantages being:—

Low maintenance (very good "life cost" value)
Very stable (won't warp or twist)
Environmentally friendly
Long lasting
splinter and rot resistant Being a man made "extruded" product, it is possible to make any shape that may be made via conventional plastics profile extrusion. Whilst most decking boards are substantially rectangular in the shape of a standard decking board, because of the inherent stability of the board it has become fairly standard to extrude boards with grooves in the side of the board to allow a "biscuit-type" fixing to be used to hold down the boards from the sides—thus eliminating the need for screws and nails to be used through the top of the board. This makes for a very aesthetically pleasing look to the deck as the fixing is substantially "hidden". Biscuit clips are generally made from some type of plastic—they come in a large range of "proprietary" shapes and sizes but substantially have a centre section where the screw goes through, and a wing on each side that sits into the groove of the decking-board on either side of the clip.

However, biscuit clips tend to be quite fiddly due to having to fit the "biscuit" into the groove in the board and the drive a very small headed screw in between the boards. It is a two-part process as the screws cannot be fully tightened until the following board is laid.

Most screws used in the biscuit clip systems are specific, and are not suitable for use with either hardwood or steel joist systems making them very difficult to use in at least one of these environments depending on which screw is fitted to the biscuit clip in the manufacturing process.

Biscuit clips generally require "double joist" to be used at butt joins due to the minimal holding length of the biscuit.

Biscuit clips tend to be relatively cheap but relatively inefficient. Therefore, it would be a distinct advantage to the decking board manufacturer to be able to maintain a current board/groove product, but offer in addition a fixing system that was significantly more efficient in terms of speed of fixing, thereby providing the customer with a speed versus labour choice when using their boards in the marketplace.

A fixed pitch, continuous clipping system has many advantages over a biscuit-clip type system, including being much faster, less labour intensive, easier to work with, and eliminates the possibility of run-out. However, the one potential disadvantage of the fixed-pitch continuous clip system is that it is somewhat reliant on the decking boards being quite consistent in size. Unfortunately, due to the very heavy reliance on recycled feedstock, which in itself varies significantly, not all manufacturers of WPC decking are able to offer the consistency of size that is generally expected from man-made, extruded products. As such, boards of varying size, especially those that may be classed as "undersize", can sit rather loosely in a fixed pitch clip. This is not ideal in the marketplace.

It will be clearly understood that, if a prior art publication is referred to herein, this reference does not constitute an admission that the publication forms part of the common general knowledge in the art in Australia or in any other country.

SUMMARY OF INVENTION

The present invention is directed to a decking clip, which may at least partially overcome at least one of the above-mentioned disadvantages or provide the consumer with a useful or commercial choice.

With the foregoing in view, the present invention in one form, resides broadly in a decking clip to allow a plurality of decking members to be attached relative to a support assembly, the decking clip including an elongate plastic body strip having a body length, the body provided with a number of openings to receive fasteners there through to attach the body relative to the support assembly, a number of upstands spaced over the body length and extending substantially perpendicularly from the body strip, substantially transversely to the body length, each upstand having at least two opposed decking board engagement arms, a first decking board engagement arm extending from a first lateral side of the upstand at an acute angle and a second decking board engagement arm extending from a second lateral side of the upstand at an acute angle, at least two centering members, at least one centering member extending from the first lateral side of the upstand between the first decking board engagement arm and the body strip and at least one centering member extending from the second lateral side of the upstand between the second decking board engagement arm and the body strip, each upstand and/or engagement arm being resiliently deformable to allow portion of a decking board to pass and to retain the decking board relative to the support assembly in a spaced apart, non-overlapping configuration.

The decking clip of the present invention is configured with features that allow the clip to be used with a wider variety of decking boards to be used. In particular, use of the decking clip of the present invention is not limited to a particular decking board configuration and may be used with decking boards that have a wide variety of proprietary edge groove configurations.

The decking clip of the present invention is preferably made from plastic material and in particular, and engineering plastic is preferably used. One particularly preferred plastic material is nylon 6. A preferred embodiment of the decking clip may be manufactured from impact modified or glass filled nylon or have impact modified or glass filled nylon added to nylon 6.

An advantage of using a plastic material is that the decking clip will be relatively easy to trim to length, typically using a saw, sharp knife or similar implement such as a snips, tin snips or scissors for example.

The decking clip of a preferred embodiment will typically attach more than one decking board relative to the support assembly. The decking clip is generally attached to the support assembly, normally to one of the joists. Preferably, the decking clip is attached substantially centrally on the joist and one or more decking clips are provided in an end-to-end configuration extending substantially over the length of each joist in the support assembly. Aligned decking clips can then be provided on one or more neighbouring joists.

In a preferred embodiment, the decking clip will typically function to attach multiple decking boards, individually relative to the support assembly, using a snap fit action such that the boards can be fitted one at a time to the decking clip. The decking clip of a preferred embodiment will also function to space adjacent decking boards from one another. In a preferred embodiment, the decking clip will also act to align the decking boards with one another.

Normally, the decking clip of the present invention is used with decking boards having a longitudinal groove or step provided on at least one and typically both side edges of each decking boards. The engagement arms of the decking clip of the present invention will typically act to abut the periphery of the longitudinal groove or the step if the decking board attempts to move upwardly.

The decking clip of the present invention includes an elongate plastic body strip having a body length, the body provided with a number of openings to receive fasteners there through to attach the body relative to the support assembly.

The plastic body strip is typically elongate and between approximately 0.5 m and 1 m in length but normally, will be approximately 0.7 m in length. The body strip will typically be substantially rectangular when viewed in plan. The plastic body strip is preferably substantially planar with the upstands standing proud of the plastic body strip.

A shaped key assembly is preferably provided at one end of the plastic body strip and a correspondingly shaped keyway assembly is preferably provided at the other end of the plastic body strip. The preferred key assembly and keyway assembly will be provided as partial thickness portions extending only part of the height of the plastic body. The key assembly preferred will typically be located as a half thickness portion at an upper side of the body strip and the keyway assembly preferably provided as a half thickness portion at a lower side of the body strip. In use, the shaped key assembly of a first decking clip will normally be aligned with the shaped keyway assembly of an adjacent decking clip during the attachment process. Preferably, the shaped key assembly will be substantially trapezoidal in shape and the shaped keyway assembly will have a corresponding shape. Providing a trapezoidal shape will typically assist with the alignment of the key assembly with the keyway assembly and proper alignment of the key assembly with the keyway assembly will also assist with the correct spacing between adjacent upstands on different decking clips.

In a preferred embodiment, at least one opening will be provided through the key assembly and the keyway assembly. When the key assembly and the keyway assembly are aligned, preferably at least one opening in each will be aligned to allow a fastener to extend through the aligned key assembly and the keyway assembly.

A number of openings are provided in the elongate plastic body strip for fasteners to attach the elongate body strip to the support assembly. Preferably, the openings will be spaced evenly over the length of the elongate plastic body strip. In a preferred embodiment, at least one opening is provided on each side of each upstand and preferably, a pair of openings is provided on each side of each upstand which will act to fix the body strip to the support assembly immediately adjacent each of the upstand is on both sides of the upstand.

Openings provided in the body strip for fasteners may have a shaped periphery in order to accept a screw fastener closely. Preferably, openings provided to attach the elongate body strip to the support assembly are provided in a recessed central portion.

A raised portion is preferably provided along each side edge of the body strip on an upper side of the body strip, to provide the body strip with raised side edges and a recessed or lower level, lower height central portion. The raised portions will typically form rest surfaces for an underside of decking members when attached. The height of the raised portions will typically be optimised relative to the lower end of the engagement arms to account for the particular thickness of the decking board used. In other words, the dimension between an upper side of the raised portion and the lower end of the engagement arms should be approximately equal to the thickness of the decking board between the base of the decking board and the lower side of the peripheral groove or step provided on the longitudinal edge of the decking board.

The upstand may also be provided on or extending from a raised portion. In a preferred configuration, the raised portion from which the upstand extends will typically be oriented transversely to the raised portions extending along each side edge of the body strip. Again, the raised portions will preferably define a number of recessed central portions over the length of the body strip with the openings for fasteners typically provided in the recessed central portions.

One or more gaps will preferably be provided between raised portions extending along each side edge of the body strip. Typically, at least one gap will be provided in each raised portion between adjacent upstands. The provision of at least one gap in this location will preferably allow water to drain from be decking clip if water manages to reach this position and/or to allow air to flow underneath the decking board.

A transversely extending attachment plate will normally be provided between adjacent upstands. Portions will typically be removed from either side of the attachment plate to form openings, in order to reduce the amount of material used to form the elongate body strip. In a preferred form, the least one gap provided in each raised portion between adjacent upstands will preferably be provided adjacent to the attachment plate. The attachment plate will normally have at least one opening therethrough to receive a fastener to assist with attachment of the body strip relative to the support assembly.

The decking clip of the present invention also includes a number of upstands spaced over the body length and extending substantially perpendicularly from the body strip, substantially transversely to the body length. As mentioned above, in a preferred form, each upstand will extend from a transversely extending raised portion. Each upstand will preferably include a thickened base portion, which provides strength to the upstand and a thinner upper portion. An angled transition is typically provided between the thickened base portion and the thinner upper portion, preferably angled outwardly and downwardly.

Each upstand will typically be generally rectangular when viewed in elevation. Each upstand will typically have arcuate outer corners between a substantially planar side edge and a substantially planar top edge. Each of the upstands will typically be substantially planar albeit preferably of portions of different thickness.

Each upstand will preferably extend substantially 90° to the plane of the body strip. Each upstand will preferably extend transversely across the body strip at approximately 90°.

The upstands are preferably regularly spaced from one another. In use, a decking board of one or more standard widths will be provided and preferably, the separation distance between the respective upstands on a particular decking clip is slightly greater than the board width that will be attached to the decking clip in order to allow for the engagement arms.

Typically, four to six decking boards will be attached per decking clip although there could be fewer or more decking boards provided depending upon the length of the body strip, and the width of the decking boards used. However, the decking clip will be manufactured for decking boards of a specific width although the decking clip may be manufactured in a number of different embodiments to suit different width decking boards or different decking board widths on the same decking clip to form a pattern for example.

Generally, four to six upstands are provided on each of the preferred decking clips, spaced equally over the length of the body strip. It is preferred that the upstands at either end of the decking clip are spaced from the terminal end of the body strip such that when two decking clips are located on a support assembly with the key assembly properly located in the keyway assembly, the dimension between adjacent upstands is maintained for the decking board width.

Each upstand may be resiliently deformable, preferably to a small degree in order to allow passage of a portion of the decking board during attachment of the decking boards but preferably, the upstands are substantially rigid and it is the engagement arms which are very slightly resiliently deformable. Different portions of each upstand may be resiliently deformable to different degrees. In a preferred form, each upstand will preferably include a thickened base portion, which provides strength to the upstand and a thinner upper portion. In one preferred form, the thickened base portion may be more rigid or less resiliently deformable (although some flexibility will be present) than the thinner upper portion, which will be more resiliently deformable than the thickened base portion. This will typically allow the upstand to resiliently deform during location of the board but then to return as much as possible to the preferred perpendicular orientation.

Each upstand of the decking clip will preferably have at least two opposed decking board engagement arms, a first decking board engagement arm extending from a first lateral side of each upstand at an acute angle and a second decking board engagement arm extending from a second lateral side of each upstand at an acute angle, each upstand and/or engagement arm being resiliently deformable to allow portion of a decking board to pass and to retain the decking board relative to the support assembly in a spaced apart, non-overlapping configuration.

One or more engagement arms can be provided on each side of the upstand. There may be two engagement arms provided in a spaced apart configuration on each side of the upstand or a single engagement arm on each side of each upstand may be provided. The provision of two engagement arms on each side of the upstand with a slot between them gives similar holding power to one arm, but reduces stress on each engagement arm when a board is inserted (especially at cold temperatures), so there is less chance of an engagement arm being broken.

It is also preferred that the engagement arms do not extend the full width of the upstand. In particular, it is preferred that the end edges of the engagement arms are typically spaced inwardly from the side edges of the upstand. It is preferred that the end edges of the engagement arms are substantially planar rather than arcuate.

Each engagement arm will preferably have a bottom edge which is substantially parallel to the plane of the body. Each engagement arm will typically have an upper edge which is coplanar with the top of the upstand. In the particularly preferred embodiment in which the engagement arm and upstand are moulded in a single piece, the upper periphery of the engagement arms is typically coplanar with the top edge of the upstand.

Each engagement arm is preferably provided at an acute angle relative to the upstand. Although any angle can be used, an angle of approximately 15° to 35° with an angle of approximately 30° from the upstand is particularly preferred. Each engagement arm will preferably extend outwardly and downwardly toward the body strip.

The decking clip of the preferred embodiment is typically manufactured in one piece with all parts integrally formed. This is normally achieved by a moulding process.

The decking board engagement arms and centering members are preferably resiliently deformable also but will preferably allow a greater degree of resilient deformation or a lesser resistance to resilient deformation than the upstand, the thickened base portion or the thinner upper portion. In a particularly preferred embodiment of the present invention, the thicker base portion of each upstand will be most resistant to resilient deformation, and the decking board engagement arms and centering members will be the least resistant to resilient deformation with the thinner upper portion of each upstand having a degree of resistance to resilient deformation between the thicker base portion and the decking board engagement arms and centering members.

According to the present invention, each upstand also includes at least two centering members, at least one centering member extending from the first lateral side of the upstand between the first decking board engagement arm and the body strip and at least one centering member extending from the second lateral side of the upstand between the second decking board engagement arm and the body strip.

The centering members can have any shape. Preferably, the centering members extend laterally a lesser distance than the engagement arms. In a preferred embodiment, the centering members will extend further on each side of the upstand than the enlarged base of the upstand in order to abut the edge of a decking board before the enlarged base abuts the edge of the board. In the preferred embodiment, the centering members will typically shelter under the footprint of the engagement arms and are preferably not visible from above.

Preferably, the centering members are smaller in dimension than the engagement arms. In particular, is preferred that the centering members do not extend as far from the upstand as the engagement arms. It is preferred that the centering members are thinner in cross-sectional shape than the engagement arms and therefore use less material than the engagement arms.

In one preferred embodiment, the centering members may extend from the upstand substantially parallel to the engagement arms but spaced therefrom. In an alternative embodiment, the centering members may extend perpendicularly to the upstand or at an angle other than parallel to the engagement arms, as the function of the centering members is to abut a portion of a decking board located between a pair of spaced apart upstands in order to centre the board and/or account for any inconsistencies in the overall shape and dimension of the board.

Preferably, the centering members are angled downwardly extending away from the upstand.

Although the centering members may have any shape, it is preferred that they are substantially planar. In a preferred embodiment, an outer free end of each of the centering members is preferably shaped to abut a portion of a decking board. In a particularly preferred embodiment, the outer free end of each of the centering members has a portion extending substantially parallel to the body of the clip.

The centering members may be resilient or not. If the centering members are resilient, they may not function to centre the board or account for any inconsistency in the overall shape and dimension of the board with as much force or resistance as a non-resilient centering member, but a non-resilient or rigid centering member may be prone to breakage. For this reason, a resilient centering member is preferred, but with a degree of resilience that makes the centering member relatively non-resilient compared to the decking board engagement arms. However, the material used to form the centering members (which will typically be integrally formed with the remainder of the clip) may provide a degree of resilient deformation due to the thickness of the material. Therefore, it is preferred if the centering members are relatively non-resilient but with a small amount of deformation possible.

The centering members may have a degree of resistance to resilient deformation which is approximately equal to that of the decking board engagement arms in material terms but due to their smaller size, will exhibit a greater resistance to resilient deformation than the decking board engagement arms.

In use, the engagement arms of each upstand will preferably act to hold down the board and the centering members will typically act to centre the board between the upstands and/or account for any inconsistency in the overall shape and dimension of the decking board.

In use, the decking clip will typically be attached to an upper planar edge of a joist or other surface in a support assembly and then one or more adjacent decking clips provided in an end-to-end configuration. A decking board with a groove or step in a side edge can then be provided at an angle to locate the groove or step in one side edge relative to an engagement arm on one upstand. This will normally cause the underside of the decking board to rest on the engagement arm on an adjacent upstand at which time force can be applied to an upper surface of the decking board to force the decking board downwardly. This will have the effect of temporarily and resiliently deformable one or both of the upstand and/or the at least one engagement arm while the decking board passes the engagement arm and engagement arm will then enter the groove or step in the side edge of the decking board and engagement arm will preferably abut an upper surface of the periphery of the groove or step in the side edge of the decking board to hold the decking board to the support assembly. The preferred substantially parallel lower edge of the engagement arm will resist any upward movement of the decking board.

In a further form, the present invention resides in a method of use of one or more decking clips as hereinbefore described to attach at least one decking board relative to a joist or other surface in a support assembly.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DESCRIPTION OF EMBODIMENTS

Figure 1:
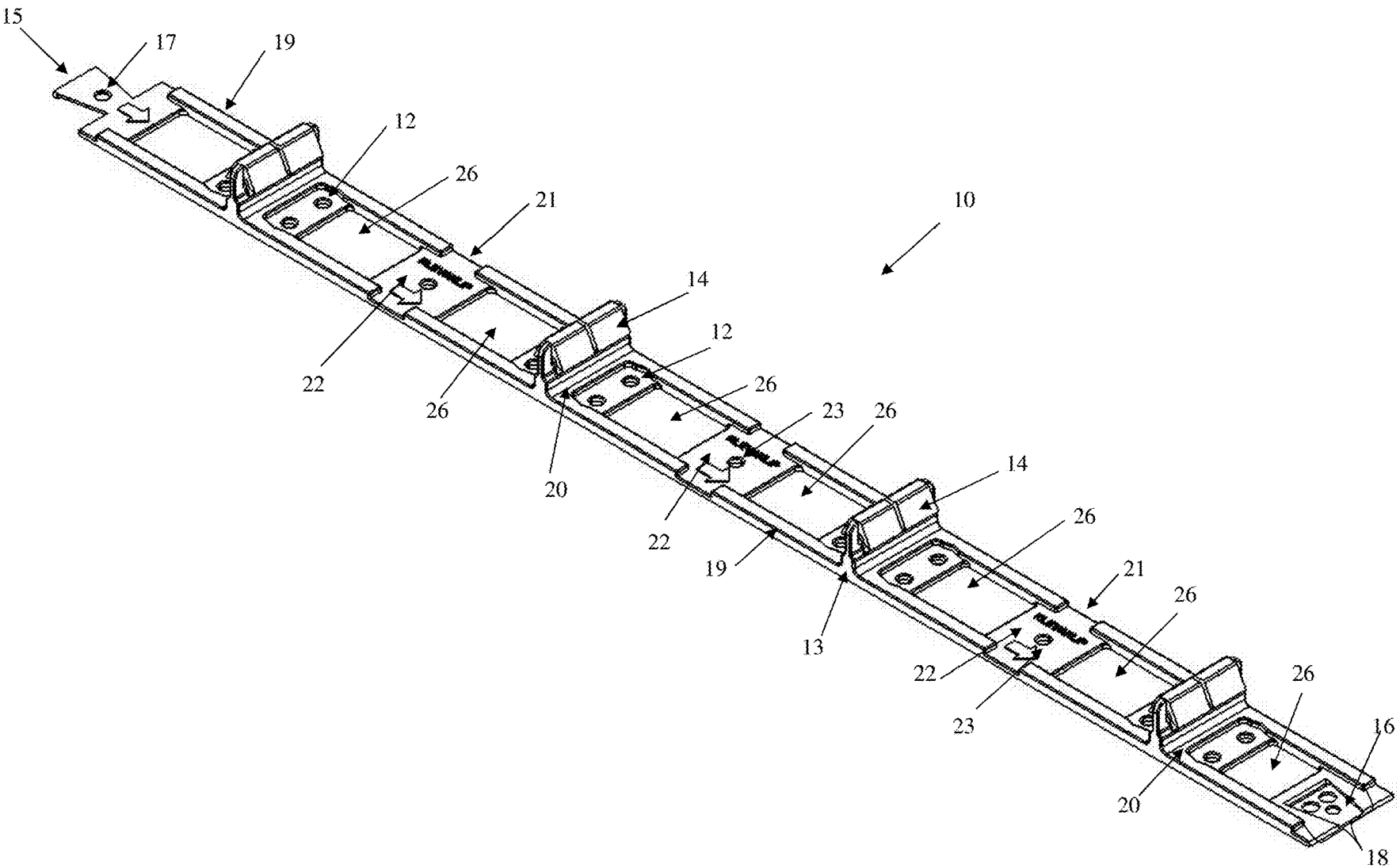
FIG. 1 is an isometric view from above of a decking clip according to a preferred embodiment of the present invention.
Figure 2:
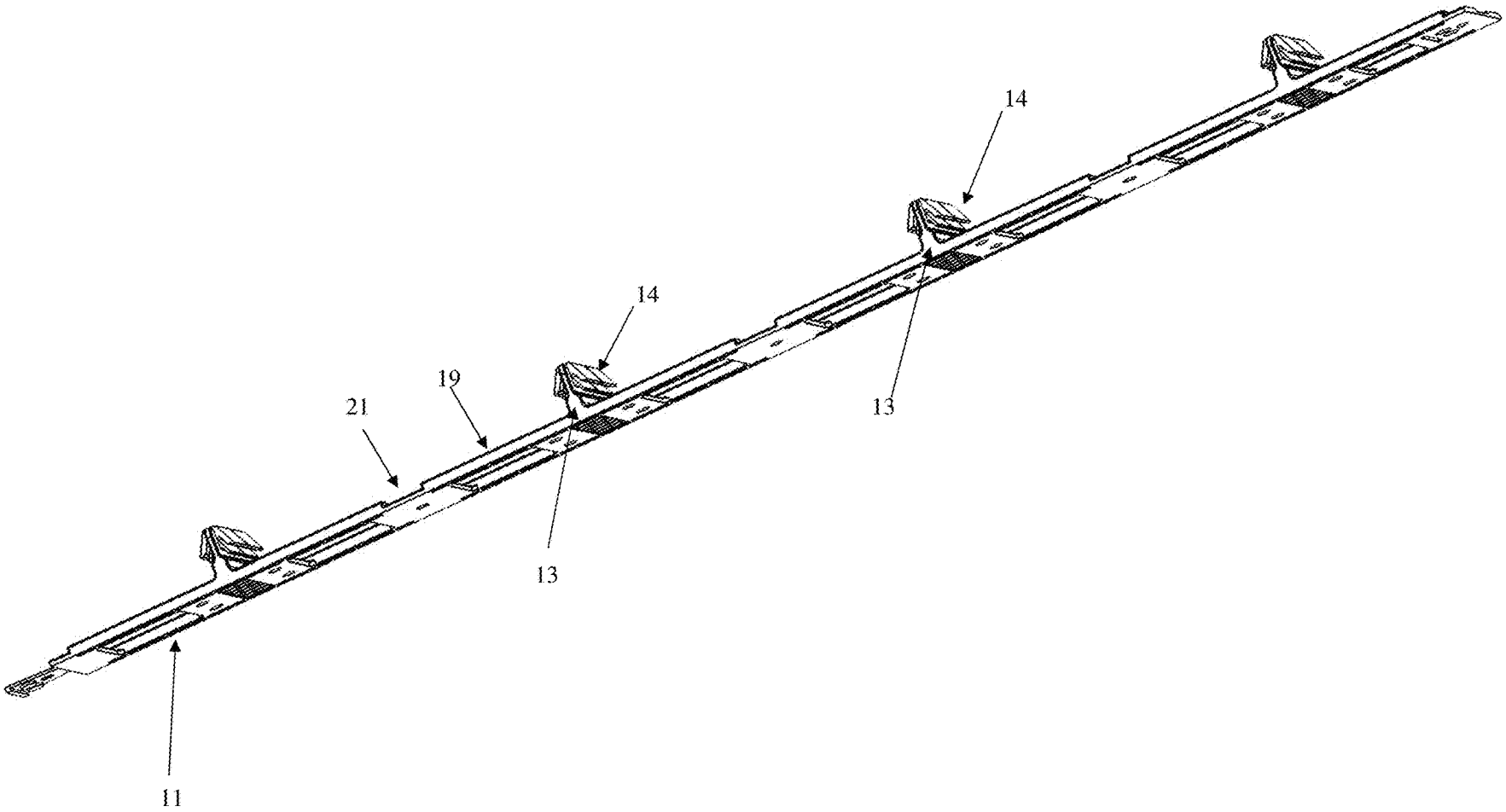
FIG. 2 is an isometric view from below of the decking clip illustrated in FIG. 1.
Figure 3:
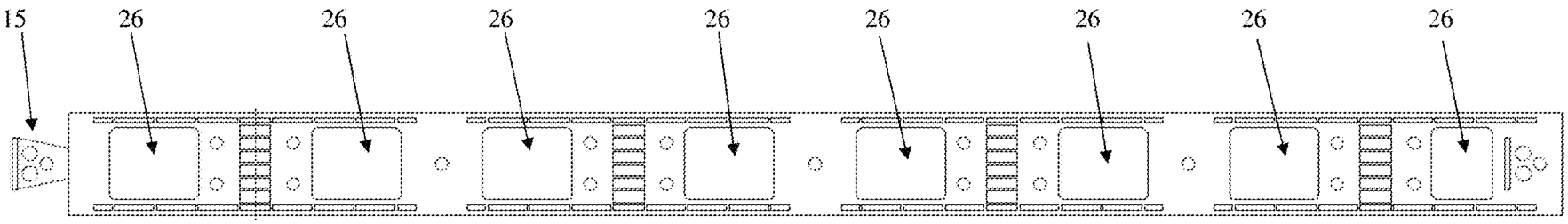
FIG. 3 is a view from below of the decking clip illustrated in FIG. 1.

According to a particularly preferred embodiment of the present invention, a decking clip is provided.

The decking clip 10 allows a plurality of decking members (illustrated in FIG. 9) to be attached relative to a support assembly by mounting the decking clip, generally a number of decking clips, in an end to end configuration on adjacent joists and then laying the decking members relative to the decking clips.

The decking clip 10 of the illustrated preferred embodiment includes an elongate plastic body strip 11 having a body length. The body strip 11 is provided with a number of openings 12 to receive fasteners (not shown) therethrough to attach the body strip 11 relative to the support assembly. The preferred embodiment also includes a number of upstands 13 spaced over the body length and extending substantially perpendicularly from the body strip 11, substantially transversely to the body length, each upstand 13 having at least two opposed decking board engagement arms 14, a first decking board engagement arm extending from a first lateral side of each upstand 13 at an acute angle and a second decking board engagement arm extending from a second lateral side of each upstand 13 at an acute angle, each upstand 13 and/or engagement arm 14 being resiliently deformable to allow portion of a decking board to pass and to retain the decking board relative to the support assembly in a spaced apart, non-overlapping configuration.

The decking clip 10 of the preferred embodiment is preferably made from plastic material and in particular, and engineering plastic is preferably used. One particularly preferred plastic material is nylon 6. A preferred embodiment of the decking clip may be manufactured from impact modified or glass filled nylon or have impact modified or glass filled nylon added to nylon 6.

The decking clip of a preferred embodiment will typically attach more than one decking board relative to the support assembly, normally transversely to the decking clips in the spaces between adjacent upstands 13. The decking clip 10 is generally attached to the support assembly, normally to one of the joists. Preferably, the decking clip is attached substantially centrally of the joist and one or more decking clips 10 are provided in an end-to-end configuration extending substantially over the length of each joist in the support assembly. Any fastening mechanism may be used to attach the decking clip to the support assembly including nails and/or screws and the like.

In a preferred embodiment, the decking clip 10 will typically function to attach multiple decking boards individually relative to the support assembly using a snap fit action such that the boards can be fitted one at a time to the decking clip 10. The decking clip of the preferred embodiment will also function to space adjacent decking boards from one another and also act to align the decking boards with one another for a consistent appearance.

Figure 9:
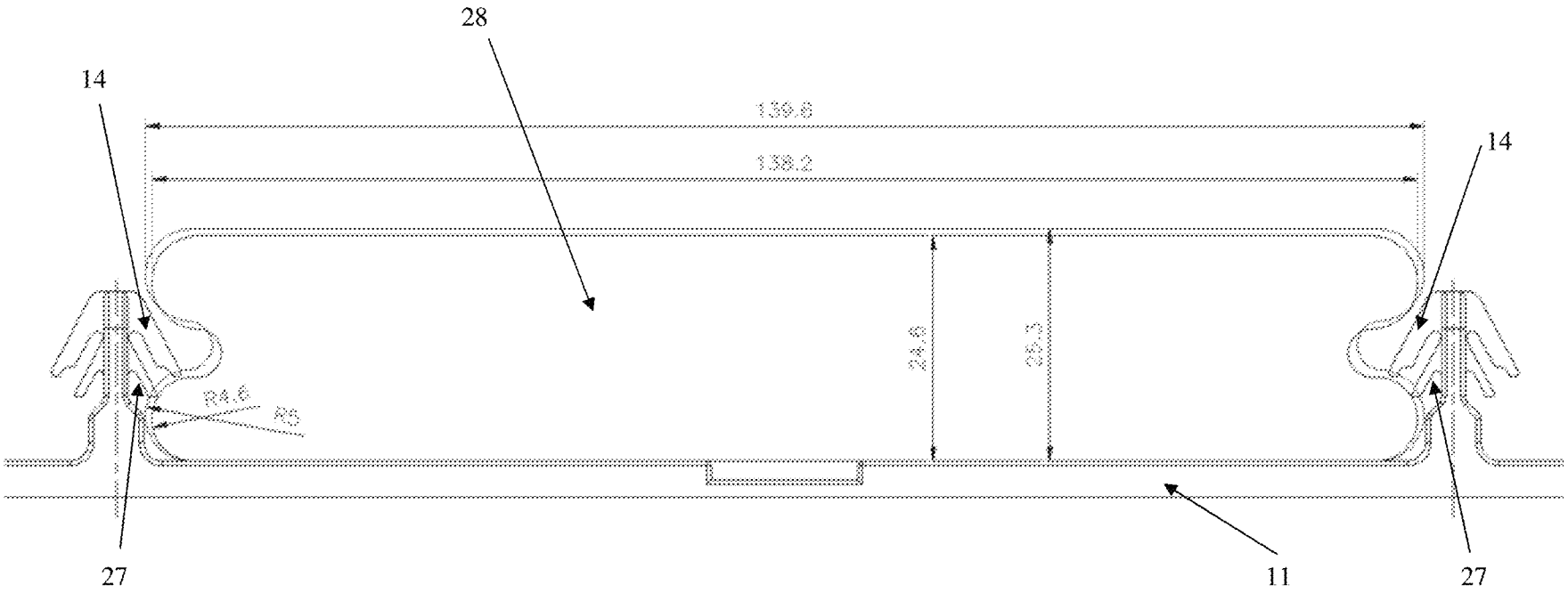
FIG. 9 is an end view of a portion of the decking clip illustrated in FIG. 1 with a pair of decking boards illustrated relative thereto showing the engagement and centering for out of size decking boards.

Normally, the decking clip of the present invention is used with decking boards having a longitudinal groove provided on at least one and typically both side edges of each decking boards as illustrated in FIG. 9. The engagement arms 14 of the decking clip 10 of the preferred embodiment will typically act to abut the periphery of the longitudinal groove if the decking board attempts to move upwardly.

Figure 4:
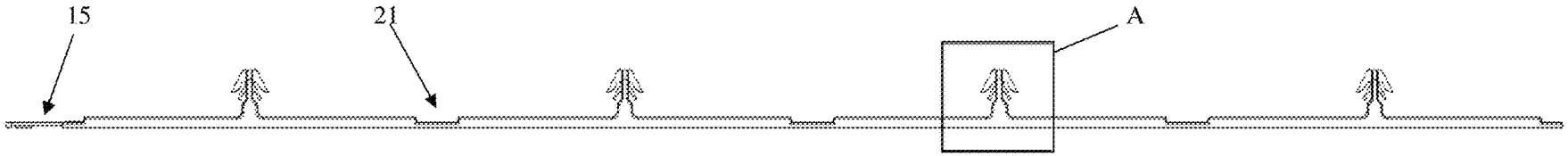
FIG. 4 is a view from the side of the decking clip illustrated in FIG. 1.

The plastic body strip 11 is typically elongate and between approximately 0.5 m to 1 m in length but normally, will be approximately 0.7 m in length. The body strip 11 will typically be substantially rectangular when viewed in plan as seen in FIG. 4 in particular. The plastic body strip 11 is preferably substantially planar with the upstands 13 standing proud of the plastic body strip 11.

In the illustrated embodiment, a shaped key assembly 15 is provided at one end of the plastic body strip 11 and a correspondingly shaped keyway assembly 16 is provided at the other end of the plastic body strip 11. The preferred key assembly 15 and keyway assembly 16 are provided as partial thickness portions extending only part of the height of the plastic body 11. The key assembly 15 is located as a half thickness portion at an upper side of the body strip 11 at one end of the body strip 11 and the keyway assembly 16 is provided as a half thickness portion at a lower side of the body strip at the other end of the body strip 11. In use, the shaped key assembly 15 of a first decking clip will normally be aligned with the shaped keyway assembly 16 of an adjacent decking clip during the attachment process. Preferably, the shaped key assembly 15 is substantially trapezoidal in shape as illustrated in FIG. 4 and the shaped keyway assembly 16 will have a corresponding shape. Providing a trapezoidal shape will typically assist with the alignment of the key assembly 15 with the keyway assembly 16 and proper alignment of the key assembly 15 with the keyway assembly 16 will also assist with the correct spacing between adjacent upstands 13 on different decking clips 10 where multiple decking clips are used.

In the preferred embodiment illustrated, an opening 17 is provided through the key assembly 15 and at least one alignable opening is provided through the keyway assembly 16. When the key assembly 15 and the keyway assembly 16 are aligned, preferably the openings in each will be aligned to allow a fastener to extend through the aligned key assembly 15 and the keyway assembly 16.

A number of openings 12 are provided in the elongate plastic body strip 11 for fasteners to attach the elongate body strip 11 to the support assembly. Preferably, the openings 12 will be spaced evenly over the length of the elongate plastic body strip 11. In a preferred embodiment, a pair of openings 12 is provided on each side of each upstand 11 which will act to fix the body strip 11 to the support assembly immediately adjacent each of the upstands 13 on both sides of each upstand 13.

Openings 12 for fasteners provided in the body strip 11 may have a shaped periphery in order to accept a screw fastener closely. Preferably, the openings 12 provided to attach the elongate body strip 11 to the support assembly are provided in a recessed central portion 18.

A raised portion 19 is preferably provided along each side edge of the body strip 11 on an upper side of the body strip 11, to provide the body strip 11 with raised side edges and a recessed or lower level, lower height central portion 18. The raised portions 19 also form rest surfaces for an underside of decking members when attached. The height of the raised portions 19 will typically be optimised relative to the lower end of the engagement arms 14 to account for the particular thickness of the decking board used. In other words, the dimension between an upper side of the raised portion 19 and the lower end of the engagement arms 14 should be approximately equal to the thickness of the decking board between the base of the decking board and the lower side of the peripheral groove provided on the longitudinal edge of the decking board.

The upstand 13 is also provided on or extending from a raised portion 20. In a preferred configuration, the raised portion 20 from which the upstand 13 extends is oriented transversely to the raised portions 19 extending along each side edge of the body strip 11. Again, the raised portions 19, 20 will preferably define a number of recessed central portions 18 over the length of the body strip 11 with the openings 12 for fasteners typically provided in the recessed central portions 18.

One or more gaps 21 will preferably be provided between raised portions 19 extending along each side edge of the body strip 11. In the illustrated embodiment, one gap 21 is provided between adjacent upstands 13. The provision of the gap 21 in this location will preferably allow water to drain from be decking clip 10 if water manages to reach this position and/or to allow air to flow underneath the decking board.

A transversely extending attachment plate 22 will normally be provided between adjacent upstands 13. Portions will typically be removed from either side of the attachment plate 22 to form openings 26 in order to reduce the amount of material used to form the elongate body strip 11. In a preferred form, the gap 21 provided in each raised portion 19 between adjacent upstands 13 will preferably be provided adjacent to the attachment plate 22. The attachment plate will normally have an opening 23 therethrough to receive a fastener to assist with attachment of the body strip 11 relative to the support assembly.

Figure 8:
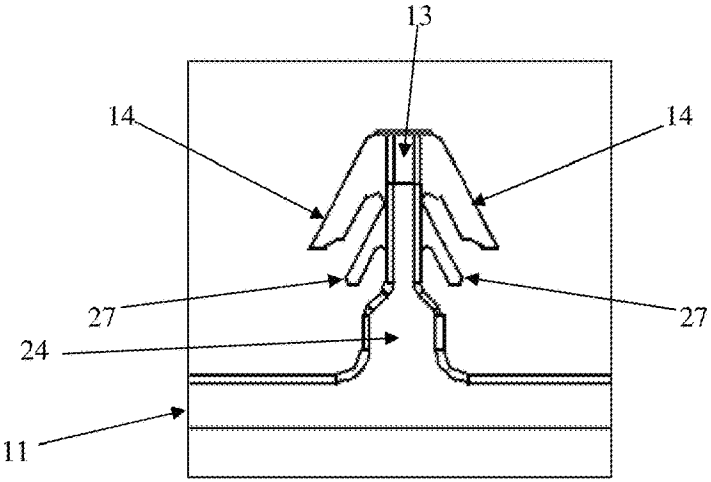
FIG. 8 is a detail view from the side of the portion identified in FIG. 4 using reference letter "A".
Figure 7:
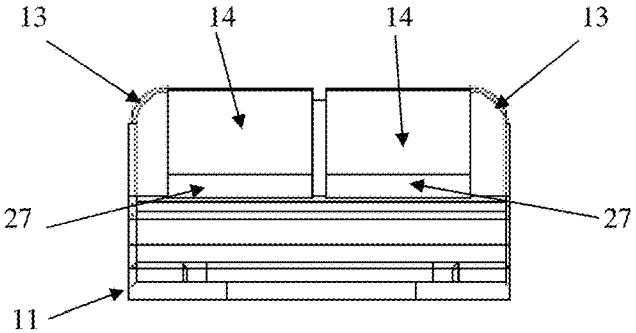
FIG. 7 is a view from one end of the decking clip illustrated in FIG. 1.

As mentioned above, in a preferred form, each upstand 13 will extend from a transversely extending raised portion 20. As illustrated in FIG. 8, each upstand 13 includes a thickened base portion 24 and a thinner upper portion 25. An angled transition is typically provided between the thickened base portion 24 and the thinner upper portion 25, preferably angling outwardly and downwardly.

Each upstand 13 will typically be generally rectangular when viewed in elevation. Each upstand 13 will typically have an arcuate outer corner between a substantially planar side edge and a substantially planar top edge. Each of the upstands 13 will typically be substantially planar albeit preferably of portions of different thickness.

Each upstand 13 will preferably extend substantially 90° to the plane of the body strip 11 and extend transversely across the body strip 11 at approximately 90°.

The upstands 13 are preferably regularly spaced from one another. In use, a decking board of one or more standard widths will be provided and preferably, the separation distance between the respective upstands 13 on a particular decking clip is slightly greater than the board width that will be attached to the decking clip 10 in order to allow for the engagement arms 14.

Typically, four to six decking boards will be attached per decking clip 10 although there could be fewer or more decking boards provided depending upon the length of the body strip 11, and the width of the decking boards used. However, the decking clip 10 will be manufactured for decking boards of a specific width although the decking clip 10 may be manufactured in a number of different embodiments to suit different width decking boards.

Generally, four to six upstands 13 are provided on each of the decking clips 10, spaced equally over the length of the body strip 11. It is preferred that the upstands at either ends of the body strip 11 are spaced from the terminal end of the body strip 11 such that when two decking clips 10 are located on a support assembly with the key assembly 15 properly located in the keyway assembly '6, the dimension between adjacent upstands 13 is maintained for the decking board width.

Each upstand 13 may be resiliently deformable, preferably to a small degree in order to allow passage of a portion of the decking board during attachment of the decking boards but preferably, the upstands 13 are substantially rigid and it is the engagement arms 14 which are very slightly resiliently deformable.

Figure 5:
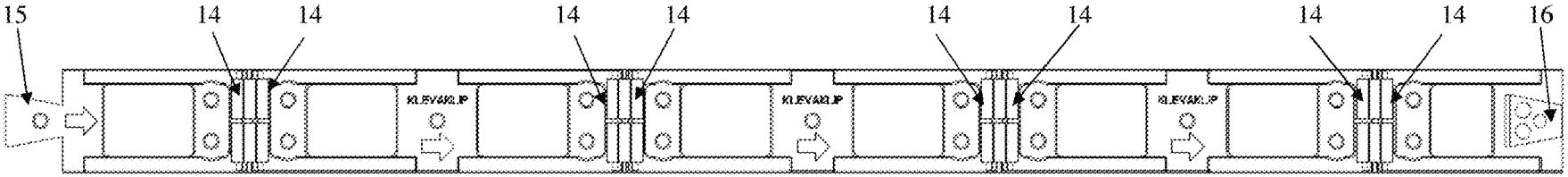
FIG. 5 is a view from above of the decking clip illustrated in FIG. 1.

One or more engagement arms 14 can be provided on each side of the upstand 13. Preferably, there will be two engagement arms provided in a spaced apart configuration on each side of the upstand or a single engagement arm 14 on each side of each upstand 13 as illustrated in FIG. 5 may be provided.

It is also preferred that the engagement arms 14 do not extend the full width of the upstand 13. In particular, it is preferred that the end edges of the engagement arms 14 are typically spaced inwardly from the side edges of the upstand 13 as can clearly be seen in FIG. 5. It is preferred that the end edges of the engagement arms 14 are substantially planar rather than arcuate.

Figure 6:
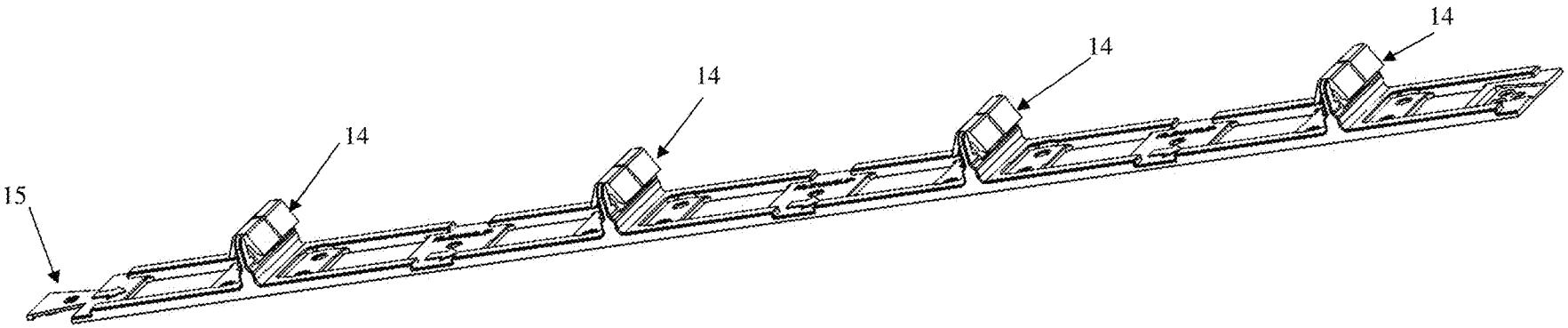
FIG. 6 is an alternative isometric view of the decking clip illustrated in FIG. 1.

Each engagement arm 14 will preferably have a bottom edge which is substantially parallel to the plane of the body strip 11 as shown in FIG. 6. Each engagement arm 14 will typically have an upper edge which is coplanar with the top of the upstand 13. In the particularly preferred embodiment in which the engagement arm 14 and upstand 13 are moulded in a single piece, the upper periphery of the engagement arms 14 is typically coplanar with the top edge of the upstand 13.

Each engagement arm 14 is preferably provided at an acute angle relative to the upstand 13. Although any angle can be used, and angle of approximately 30° from the upstand 13 is particularly preferred. Each engagement arm 14 will preferably extend outwardly and downwardly toward the body strip 11.

As illustrated in FIGS. 8 and 9 in particular, each upstand 13 also includes a pair of centering members 27, one centering member 27 extending from the first lateral side of the upstand 13 between the first decking board engagement arm 14 and the body strip 11 and one centering member 27 extending from the second lateral side of the upstand 13 between the second decking board engagement arm 14 and the body strip 11.

As illustrated in FIG. 8 best, the centering members 27 extend laterally a lesser distance than the engagement arms 14. The centering members 27 extend further on each side of the upstand 13 than the enlarged base 24 of the upstand 13 in order to abut the edge of a decking board 28 before the enlarged base 24 abuts the edge of the decking board 28.

In the illustrated preferred embodiment, the centering members 27 extend from the upstand 13 substantially parallel to the engagement arms 14 but spaced therefrom.

Although the centering members 27 may have any shape, it is preferred that they be substantially planar. In a preferred embodiment, an outer free end of each of the centering members is preferably shaped to abut a portion of a board as shown in FIG. 9. In a particularly preferred embodiment, the outer free end of each of the centering members has a portion extending substantially parallel to the body of the clip.

The centering members may be resilient or not. If the centering members are resilient, they may not function to centre the board or account for any inconsistency in the overall shape and dimension of the board with as much force or resistance as a non-resilient centering member. For this reason, a nonresilient centering member is preferred. However, the material used to form the centering members (which will typically be integrally formed with the remainder of the clip 10) may provide a degree of resilient deformation due to the thickness of the material. Also, it is preferred that the centering members not be absolutely rigid or they may be more prone to breakage as the board is installed. Therefore, it is preferred if the centering members 27 are predominately rigid but with a small amount of deformation possible.

In use, the engagement arms 14 of each upstand 13 act to hold down the board 28 as illustrated in FIG. 9 and the centering members 27 act to centre the board 28 between the upstands 13 and/or account for any inconsistency in the overall shape and dimension of each decking board 28.

The decking clip 10 of the preferred embodiment is typically manufactured in one piece with all parts integrally formed. This is normally achieved by a moulding process.

In use, the decking clip 10 will typically be attached to an upper planar edge of a joist or other surface in a support assembly and then one or more adjacent decking clips 10 provided in an end-to-end configuration. Normally, aligned decking clips will be provided on adjacent joists. A decking board with a groove or step in a side edge can then be provided at an angle to locate the groove in one side edge relative to an engagement arm 14 on one upstand 13. This will normally cause the underside of the decking board to rest on the engagement arm 14 on an adjacent upstand 13 at which time force can be applied to an upper surface of the decking board to force the decking board downwardly. This will have the effect of temporarily and resiliently deforming one or both of the upstands 13 and/or the at least one engagement arm 14 while the decking board passes the engagement arm 14 and the lower, outer part of the engagement arm 14 will then enter the groove or step in the side edge of the decking board and engagement arm 14 will preferably abut an upper surface of the periphery of the groove or step in the side edge of the decking board to hold the decking board to the support assembly. The preferred substantially parallel lower edge of the engagement arm will resist any upward movement of the decking board.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A decking clip to allow a plurality of decking members to be attached relative to a support assembly, the decking clip including an elongate plastic body strip having a body length, the body provided with a. a number of openings to receive fasteners there through to attach the body relative to the support assembly; and b. a number of upstands spaced over the body length and extending substantially perpendicularly from the body strip, substantially transversely to the body length, each upstand having a thicker lower portion having a first resistance to resilient deformation and a thinner upper portion having a second resistance to resilient deformation, i. at least two opposed decking board engagement arms having a third resistance to resilient deformation, a first decking board engagement arm extending from a first lateral side of the upstand at an acute angle and a second decking board engagement arm extending from a second lateral side of the upstand at an acute angle, the decking board engagement arms engaging a respective decking board by abutment with a groove or step provided on at least one edge of the respective decking board, and ii. at least two centering members having a fourth resistance to resilient deformation, at least one centering member extending from the first lateral side of the upstand between the first decking board engagement arm and the body strip and at least one centering member extending from the second lateral side of the upstand between the second decking board engagement arm and the body strip, each upstand and/or engagement arm being resiliently deformable to allow a portion of a decking board to pass and to retain the decking board relative to the support assembly in a spaced apart, non-overlapping configuration with the first resistance to resilient deformation higher than the second resistance to resilient deformation which is higher than both of the third and fourth resistance to resilient deformation.

2. The decking clip according to claim 1 wherein the decking clip is unitary in construction and manufactured from plastic material.

3. The decking clip according to claim 1 wherein the body strip is substantially planar with the upstands extending perpendicularly to the body strip.

4. The decking clip according to claim 1 wherein a shaped key assembly is provided at one end of the plastic body strip and a correspondingly shaped keyway assembly is provided at the other end of the plastic body strip to allow the shaped key assembly of a first decking clip to be aligned with the shaped keyway assembly of an adjacent decking clip during installation.

5. The decking clip according to claim 4 wherein at least one opening is provided through the key assembly and the keyway assembly so that when the key assembly and the keyway assembly are aligned, the at least one opening in each are aligned to allow a fastener to extend through the aligned key assembly and the keyway assembly.

6. The decking clip according to claim 1 wherein a raised portion is provided along each side edge of the body strip on an upper side of the body strip, to provide the body strip with raised side edges and a recessed or lower level, lower height central portion.

7. The decking clip according to claim 1 wherein each upstand is provided on or extending from a raised portion oriented transversely to the body length of the body strip.

8. The decking clip according to claim 1 wherein a single engagement arm is provided extending on each side of each upstand, angled downwardly from an upper portion of the upstand toward the body strip.

9. The decking clip according to claim 1 wherein a single centering member is provided extending on each side of each upstand, angled downwardly from an upper portion of the upstand toward the body strip.

10. The decking clip according to claim 1 wherein the centering members extend laterally a lesser distance than the engagement arms.

11. The decking clip according to claim 1 wherein each centering member is located between the engagement arm and the body strip with a lower edge of the centering member spaced from the body strip.

12. The decking clip according to claim 1 wherein the centering members are smaller in dimension than the engagement arms and do not extend laterally as far from the upstand as the engagement arms.

13. The decking clip according to claim 1 wherein the centering members are thinner in cross-sectional shape than the engagement arms.

14. The decking clip according to claim 1 wherein the centering members extend from the upstand substantially parallel to the engagement arms but spaced therefrom.

15. The decking clip according to claim 1 wherein the centering members extend at an angle relative to the engagement arms to abut a portion of a decking board located between a pair of spaced apart upstands in order to centre the decking board and/or to account for any inconsistencies in overall shape and dimension of the decking board.

16. The decking clip according to claim 1 wherein an outer free end of each of the centering members has a portion extending substantially parallel to the body strip.

* * * * *